United States Patent [19]

West et al.

[11] 4,133,591

[45] Jan. 9, 1979

[54] GROUND CLAMP FOR DUAL ELECTRICAL CABLE TERMINALS

[75] Inventors: Edward L. West; Melvin E. Clutter, both of Centralia, Mo.

[73] Assignee: A. B. Chance Company, Centralia, Mo.

[21] Appl. No.: 819,294

[22] Filed: Jul. 27, 1977

[51] Int. Cl.[2] ..... H01R 3/06; H01R 11/10

[52] U.S. Cl. ..... 339/14 L; 339/32 R; 339/109; 339/264 L

[58] Field of Search ..... 339/14 L, 32, 33, 109, 339/110 R, 263 L, 264

[56] References Cited

U.S. PATENT DOCUMENTS

| | | | |
|---|---|---|---|
| 2,096,796 | 10/1937 | Dunaway | 339/109 |
| 2,319,602 | 5/1943 | Hendley | 339/264 L |
| 3,001,166 | 9/1961 | Cornell, Jr. | 339/32 R |

FOREIGN PATENT DOCUMENTS

| | | | |
|---|---|---|---|
| 1089827 | 9/1960 | Fed. Rep. of Germany | 339/109 |
| 483130 | 1/1970 | Switzerland | 339/264 L |

*Primary Examiner*—Joseph H. McGlynn
*Attorney, Agent, or Firm*—Schmidt, Johnson, Hovey & Williams

[57] ABSTRACT

A C-type electrical grounding clamp is provided for high voltage distribution lines wherein structure on the main body of the clamp presents at least a pair of separate, cooperable ground cable receiving elements oriented with the longitudinal axes of the cable passages in perpendicular relationship relative to one another. The user may thereby employ a plurality of the clamps all of identical construction for either phase-over-phase or phase-by-phase grounding in a manner wherein in each instance the grounding cables between adjacent conductors are all essentially parallel and of minimum length to span the distance therebetween for maximum resistance to fault current induced grounding cable whipping, and minimum imposition of non-fault stresses thereon. The clamps are especially adapted for supporting dual grounding cables between each pair of proximal conductors.

6 Claims, 6 Drawing Figures

GROUND CLAMP FOR DUAL ELECTRICAL CABLE TERMINALS

This invention relates to electrical grounding equipment for distribution lines and particularly improved C-type grounding clamps useful for phase-by-phase as well as phase-over-phase conductor systems.

C-shaped ground clamps have long been used to ground large diameter conductors used in single phase as well as three phase high voltage distribution lines. Exemplary clamps are illustrated, for example, in the Assignee's catalog under Section 9, entitled "Grounding Equipment", and especially at pages 9-6 to 9-8 inclusive dated September, 1972. Clamps of this type typically have a C-shaped body provided with means presenting a concave, conductor-gripping surface and a threaded rod supporting a jaw oriented in space, opposed relationship to the conductor-gripping surface for cooperatively gripping a conductor therebetween. The threaded clamping bolt carried by the body and supporting the jaw is selectively movable into and out of conductor-gripping disposition.

In most instances, these grounding clamps have been designed so that the ground cable (or cable terminal) is mounted on the clamp in a position approximately parallel to the longitudinal axis of the jaw-supporting eye screw. This mounting position of the cable terminal or ground conductor is less than ideal under most every condition of use. During the interval that the ground set is energized by a current of high magnitude, the electromagnetic forces imposed on the system produces high stresses at the terminal areas. This is especially true in phase-over-phase applications where the grounding cable is generally secured to the vertically stacked clamps in orientation such that the cable actually loops back upon itself at the point of securing thereof to the lower clamp. Slack must necessarily be provided in the cable to permit this looped configuration which defines a generally J-shaped path for the current. After interruption of high fault loads, the electromagnetic forces tend to whip the grounding cable inducing motion that may be likened to the path followed by a jump rope, and this is undesirable because of the stresses imposed on the cable itself ultimately resulting in cable fraying and strand breakage. In addition, the looped configuration of the ground cables causes continuous stresses to be placed thereon even though no fault currents occur, or are seen only rarely during normal current carrying use. These continuous stresses are of maximum force when the cables are cut to the shortest possible length to minimize slack. Again strand fraying and breakage can occur after extended use.

It is, therefore, a primary object of the present invention to provide an improved grounding clamp for high voltage electrical applications which may be subjected to high fault currents or placed under continuous loads for extended periods of time wherein even though a single clamp is usable for phase-by-phase as well as phase-over-phase grounding fault current induced cable whip is minimized and continuous use stresses are minimized which could ultimately break or cause the strands of the grounding cable to fray.

In this respect, it is a particularly important object of the invention to provide a clamp as described which is usable under a variety of grounding conditions and permits the user to stock only a single type of clamp for particular line duty without regard to the relative orientation of the conductors or the locations where the clamps must be placed thereon.

A further important object of the invention is to provide improved grounding clamp structure of the characteristics previously mentioned which are specially constructed to permit dual grounding cables to be provided between the clamps on adjacent conductors while at the same time allowing use of cables of minimum length which are essentially parallel between phases to thereby minimize fault current whip or deleterious continuous current stresses thereon.

A still further important object of the invention is to provide a grounding clamp which allows either dualing cables to be connected across adjacent conductors, or only a single cable located between the phases as required by the system fault current capacity without change in the functional use of the clamp or the operational use thereof.

Other important objects of the invention and advantages of the use thereof will become apparent or be explained in greater detail as the description hereof progresses.

Figure 1:
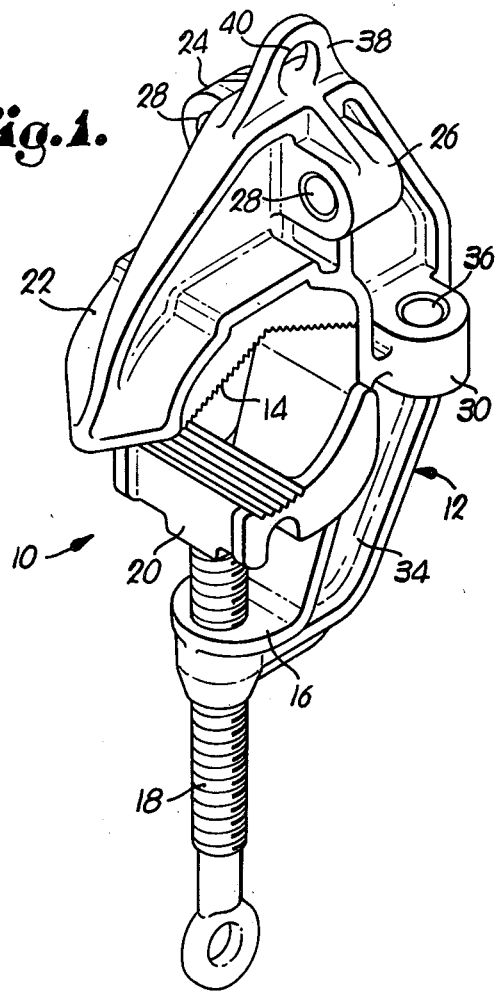
FIG. 1 is a perspective view of a C-type grounding clamp embodying the improved ground cable connector structure of this invention and illustrating the front left hand corner of the clamp.
Figure 2:
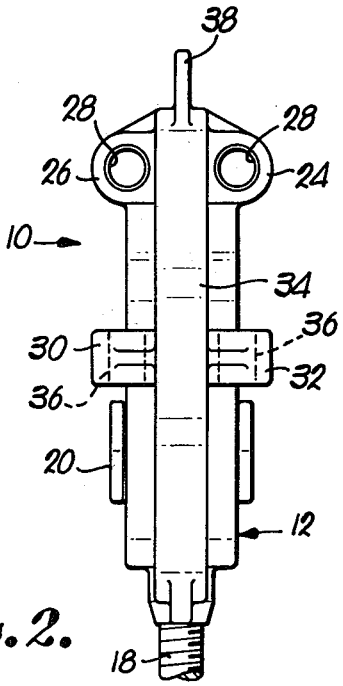
FIG. 2 is a fragmentary rear elevational view of the clamp shown in FIG. 1.

The grounding clamp for high voltage conductors and broadly designated by the numeral 10 in FIGS. 1 and 2, has a main C-shaped body 12 usually cast of aluminum or the like and provided with a concave, generally downwardly facing serrated surface 14 adapted to grip the surface of a conductor when forced thereagainst. The lower leg portion 16 of body 12 threadably supports an externally threaded eye bolt 18 mounting a conductor-engaging jaw 20 which is also serrated throughout at least a part of the horizontal extent thereof, and designed to force a conductor into engagement with surface 14 as the eye bolt 18 is rotated in a direction to shift jaw 20 toward the upper leg portion 22 of body 12. Preferably, the eye bolt or screw 18 and the contact jaw 20 are fabricated of a high strength metal alloy.

At the time of fabrication of body 12, structure is cast integral therewith for facilitating attachment of grounding cables or the like thereto, permitting clamp 10 to be used for phase-over-phase as well as phase-by-phase grounding and for connecting the assembly to a neutral below the phases or to a ground rod driven into the earth.

Figure 4:
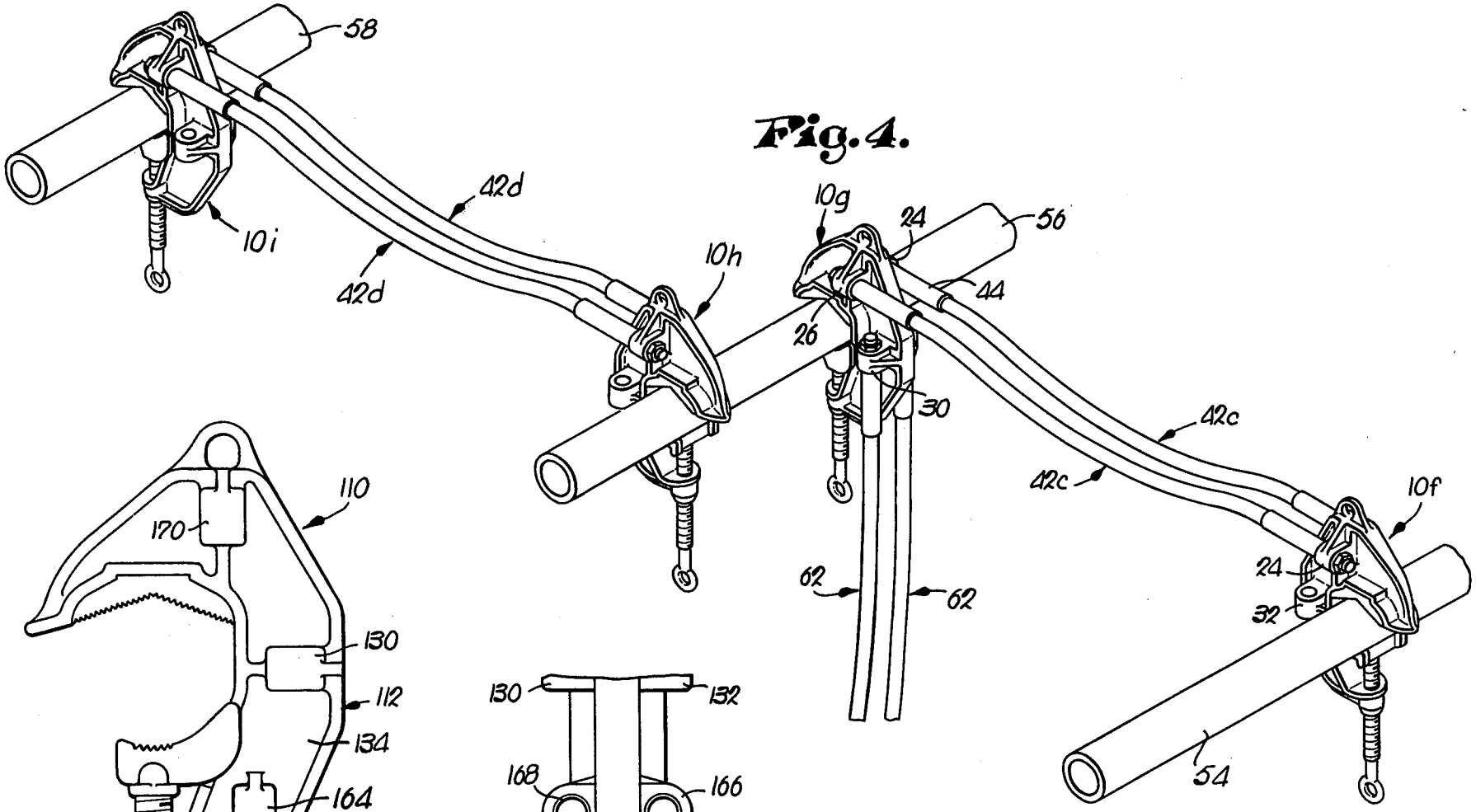
FIG. 4 is a fragmentary perspective view showing the way in which a plurality of the clamps depicted in FIGS. 1 and 2 may be effectively used for phase-by-phase grounding.

Viewing FIGS. 1 and 2, it is to be noted that a pair of integral elements comprising outwardly projecting abutments 24 and 26 are provided at the top of body 12 and projecting in opposite directions from a central bisecting plane through body 12 and the eye bolt and jaw assembly 18–20. Each of the abutments 24 and 26 is provided with an elongated cable or terminal-receiving passage 28 therein which cause abutments 24 and 26 to define spaced sleeves having parallel axes on opposite sides of body 12 above serrated contact surface 14. The terminal abutment sleeves 24 and 26 serve to facilitate phase-by-phase grounding of multiphase conductors as best shown in FIG. 4.

Body 12 is also provided with a pair of lower integrally attached abutments 30 and 32 thereon, which project from the central leg portion 34 of body 12 below abutments 24 and 26. The central abutments 30 and 32 are horizontally offset from those above as best shown in FIG. 1 (as well as in the modified clamp of FIG. 5 to be hereinafter described). Each of the abutments 30 and 32 has a vertical passage 36 therethrough for receiving cable terminals or the threaded end of a ground cable to facilitate use of clamp 10 as a phase-over-phase grounding device illustrated in FIG. 3.

Web section 38 of clamp 10 has an aperture 40 therethrough located with the axis thereof in perpendicular relationship to the axes of passages 28 and 36 as well as with respect to the main plane of body 12. Web section 38 facilitates handling of C-clamp 10 with a lineman's tool such as a hotstick or the like.

Figure 3:
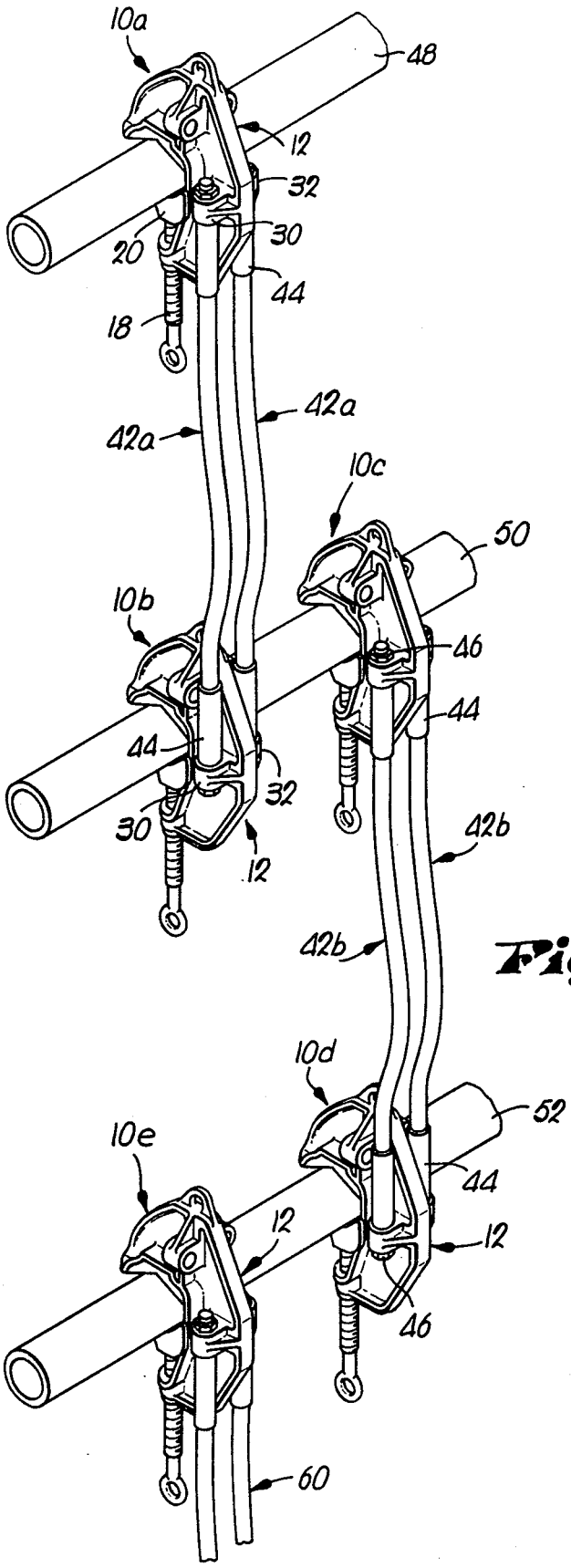
FIG. 3 is a fragmentary perspective view illustrating the way in which a series of clamps all of the same construction as the clamp illustrated in FIGS. 1 and 2, may be advantageously used to ground three-phase conductors located in phase-over-phase relationship.

As can be seen in FIG. 3, improved clamp 10 is especially adapted for grounding adjacent conductors of a three phase system using ground cables 42 of the type which are conventionally provided with threaded terminals 44. Respective terminal end segments may be passed through the passages of appropriate abutments on body 12 of clamp 10 and secured in place by corresponding nuts 46. It is apparent that the terminals 44 may be inserted in the sleeves defined by abutments 24, 26, 30 and 32 through any of the entrance openings defined by the passages therethrough, depending upon the particular installation in which the clamps 10 are being used, to minimize ground cable length and maintain parallelism between the cables between adjacent conductors as depicted in FIGS. 3 and 4.

FIG. 3 illustrates the way in which a series of clamps 10 of identical construction may be used to ground three phase conductors 48, 50 and 52 located in phase-over-phase relationship and at the same time provide ground cable connection to a neutral ground or earth ground rod through the medium of one or more cables 60 similar to ground cables 42. A clamp **10*a* secured to the uppermost conductor 48 by tightening of the jaw 20 thereof against the underside of the elongated conductor is grounded to clamp 10*b* secured to intermediate conductor 50, through the medium of ground cables 42*a* extending between and electrically connected to the abutments 30 and 32 of corresponding clamp bodies 12. Of particular note is the fact that the ground cables 42*a* not only provide a dual grounding capacity, but are also usable of a minimum length to span the distance between conductors 48 and 50 while remaining in generally parallel relationship. In fact, the length of ground cables 42*a* may be appropriately sized to be relatively taut between clamp 10*a* and the underlying clamp 10*b*. Also of special note is the fact that the orientation of abutments 30 and 32 of aligned clamps 10*a* and 10*b* is such that grounding cables 42*a* present substantially linear lengths between conductors 48 and 50 and are generally perpendicular to the longitudinal axes of the conductors so as to provide maximum resistance to fault-induced whipping that occurred with past grounding clamp assemblies. In addition, the arrangement and location of abutments 30 and 32** for vertical grounding assures maximum cable life by virtue of the fact that no undue bending stresses are imposed on the cables during continuous use and especially under energized conditions.

Clamps **10*c* and 10*b* secured to intermediate conductor 50 and the lowermost conductor 52 respectively provide a ground connection between the two lower conductors through the medium of grounding cables 42*b* extending therebetween and also joined to and supported by the abutments 30 and 32 of vertically aligned clamps 10. Here again, the length of the grounding cables 42*b* may be sized as necessary for minimum length thereof in disposition such that they cannot whip against the cables 42*a* or their respective clamps 10**.

A final clamp **10*e* is mounted on lower conductor 52 for facilitating connection of ground cable 60 to a neutral point or ground rod therebelow. In this instance, the length of the cable 60** may again be minimized.

Phase-by-phase grounding is illustrated in FIG. 4 wherein it can be seen that grounding of horizontally spaced conductors 54, 56 and 58 of a three phase system may be accomplished using four clamps 10, designated **10*f*, 10*g*, 10*h* and 10*i* respectively. In this instance, the ground cables 42*c* between conductors 54 and 56 are joined to the upper abutments 24 and 26 of corresponding clamps with the length of the ground cables therebetween being minimized as is evident from the drawing. In this instance the abutments 30 and 32 are not used except in the instance of clamp 10*g* for grounding the assembly to a neutral point or ground stake through use of cables 62. Cables 42 extending between the abutments 24 and 26 on clamps 10*h* and 10*i* secured to conductors 56 and 58** provided the electrical connection between these proximal conductors of the system.

Figure 6:
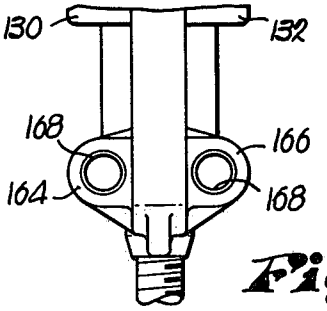
FIG. 6 is a fragmentary and elevational view of the lower part of the clamp shown in FIG. 5.
Figure 5:
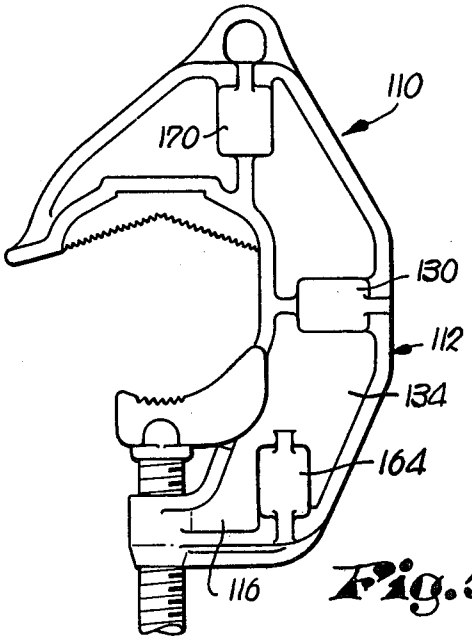
FIG. 5 is a fragmentary side elevational view of a modified clamp embodying the principles of the present invention and showing alternate terminal pad construction for horizontal phase-to-phase grounding.

A modified C-type clamp embodying the improvements of this invention is broadly designated by the numeral 110 in FIGS. 5 and 6 and differs from clamp 10 in the provision of lower apertured abutments 164 and 166 integral with the body 112 of clamp 110 adjacent the zone of merger of the lower leg portion 116 thereof with central web section 134. The passages 168 through abutments 164 and 166 are located with the axes thereof in generally parallel relationship and perpendicular to the axes of the passages through intermediate abutments 130 and 132 which correspond to the abutments 30 and 32 of clamp 10. It is also to be noted from FIG. 5 that the abutments 164 and 166 are horizontally offset from the abutments 130 to facilitate use thereof in phase-over-phase as well as phase-by-phase grounding constructions. Abutments 164 define sleeves for receiving grounding cables identical to those designated by the numeral 42. It is to be understood in this respect that abutments 164 and 166 may be provided on clamp 110 in conjunction with upper abutments 170 identical to abutments 24 and 26 on clamp 10, or may be provided in lieu of the upper abutments 170. If the upper and lower ground cable sleeves are provided on a single clamp, the terminal receiving passages therethrough are preferably located in parallel relationship, although spaced both horizontally and vertically of body 112.

The fact that the terminal-receiving abutments on clamps 10 and 110 cause the opposed faces of the clamp to be a mirror image one of the other, facilitates use of the clamp in many different environments without ground cable overlap and in most instances avoids the necessity of bending the grounding cables longitudinally thereof to accommodate a particular system. As a result, not only is mechanical stress on the clamps and cables minimized during installation and high fault current conditions, but the number of clamps and connections needed for a particular job are maintained at a minimum. The user need only stock a single type of clamp for a particular current rating regardless of the conductor locations whether it be a single phase or a multiphase distribution system.

If only a single grounding cable is required between adjacent conductors of a multiphase system, it is readily apparent that only a single clamp need be used on the intermediate conductor and the cables may still be connected to the middle clamp with the terminals inserted through the abutments in opposite directions avoiding the necessity of looping the cables as has heretofore been required and without attendant dangers of cable whip under fault conditions.

Having thus described the invention, what is claimed as new and desired to be secured by Letters Patent is:

1. A conductor clamp, comprising:

a generally C-shaped body presenting a concave, conductor-gripping surface;

a jaw oriented in spaced, opposed relationship to said conductor-gripping surface for cooperatively gripping a conductor with the latter;

means shiftably mounting said jaw on said body;

an elongated, threaded clamping bolt operatively connected to said body and jaw for selective, alternate opening and closing movement of the latter relative to said conductor-gripping surface; and structure integral with said body for presenting at least a pair of spaced unitary elements defining cable-receiving passages therethrough, said elements being oriented such that the respective longitudinal axes of said cable-receiving passages are generally in perpendicular relationship relative to one another and one of said axes is substantially parallel to the longitudinal axis of said bolt.

2. The clamp as set forth in claim 1 including structure defining another cable-receiving element on said body having the longitudinal axis thereof generally parallel to the axis of one of said pair of elements.

3. The clamp as set forth in claim 1 including a web section mounted on said body having an aperture therethrough for allowing insertion of a hotstick operating tool for facilitating handling of said clamp.

4. The clamp as set forth in claim 1 wherein said longitudinal axes of said passages lie substantially in a common plane.

5. The clamp as set forth in claim 1 wherein each of said elements comprises abutment means presenting a cable-receiving sleeve.

6. The clamp as set forth in claim 5 including laterally projecting abutments on the opposed faces of said body presenting respective aligned pairs of said sleeves.

* * * * *